US007445524B2

(12) United States Patent
Horiuchi

(10) Patent No.: US 7,445,524 B2
(45) Date of Patent: Nov. 4, 2008

(54) CONNECTOR

(75) Inventor: Hidefumi Horiuchi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/879,579

(22) Filed: Jul. 18, 2007

(65) Prior Publication Data

US 2008/0020653 A1 Jan. 24, 2008

(30) Foreign Application Priority Data

Jul. 19, 2006 (JP) ..... 2006-196825

(51) Int. Cl.
*H01R 13/514* (2006.01)

(52) U.S. Cl. ..... 439/752

(58) Field of Classification Search ..... 439/752, 439/595

See application file for complete search history.

(56) References Cited

U.S. PATENT DOCUMENTS 6,390,859 B2 5/2002 Furutani
6,749,469 B2 * 6/2004 Matsuoka ..... 439/752
6,811,451 B2 * 11/2004 Mase et al. ..... 439/752
7,175,483 B2 * 2/2007 Ishikawa ..... 439/752
2002/0086588 A1 * 7/2002 Fujita ..... 439/752

* cited by examiner

*Primary Examiner*—Gary F. Paumen
(74) *Attorney, Agent, or Firm*—Gerald E. Hespos; Anthony J. Casella

(57) ABSTRACT

When a retainer (30) is at a full locking position, back ribs (41) are located at positions right behind reinforcing portions (38). Thus, if a force acts to withdraw terminal fittings (10) and the retainer (30) tries to incline by having retaining portions (32) pushed backward, the reinforcing portions (38) come into contact with the back ribs (41) to prevent any further inclination of the retainer (30). Thus, even in a connector (1) in which cavities (21) are arranged in a row, the terminal fittings (10) can be reliably held retained by suppressing the inclination of the retainer (30). Since it is sufficient to provide the back ribs (41) in the housing (20), at least the retainer (30) needs not change its shape.

11 Claims, 13 Drawing Sheets

CONNECTOR

BACKGROUND OF THE INVENTION

1. Field of the Invention

The invention relates to a connector.

2. Description of the Related Art

U.S. Pat. No. 6,390,859 discloses a connector with a housing. Cavities are arranged at upper and lower stages in the housing for accommodating terminal fittings. A retainer mount groove extends in from an upper surface of the housing and penetrates the cavities. A side retainer can be inserted into the retainer mount groove of the housing for directly locking and retaining the terminal fittings in the cavities.

The retainer has a lattice-shaped body defined by upper and lower plates and partitioning walls that connect the upper and lower plates. Thus, a row of through holes penetrates the lattice-shaped body in forward and backward directions. The through holes correspond to the upper cavities of the housing and a space below the lower plate of the retainer body corresponds to the lower cavities of the housing. The retainer is movable between partial and full locking positions. The upper and lower plates are formed with retaining portions that are retracted from the cavities when the retainer is at the partial locking position so that the terminal fittings can be inserted and withdrawn from the cavities. However, the retaining portions are in the cavities when the retainer is at the full locking position to lock the terminal fittings.

Side plates extend down from the opposite left and right sides of the retainer main body and temporary and full holding extend down on front and rear edges of each side plate. The temporary holding arms engage partial locking projections in the retainer mount groove when the retainer reaches the partial locking position, and the full holding arms engage full locking projections in the retainer mount groove when the retainer reaches the full locking position. Thus, the retainer can be held at the respective positions.

The above-described connector requires a clearance between the retainer mount groove and the retainer so that the retainer can be pushed smoothly to the full locking position. A strong force could be exerted on the terminal fittings in a withdrawing direction while the retainer is at the full locking position. Such a force could be exerted, for example, by pulling the wires. This force would push the retaining portions of the retainer back and would urge the retainer towards an oblique incline. However, the lower plate of the lattice-shaped main body will contact the housing at an early stage of the inclination of the retainer, and will limit the inclination to a small degree. The retainer main body could be constructed to include only an upper plate, and in this situation a rearward force on the terminal fittings could incline the retainer more. Areas of engagement of the retaining portions and the terminal fittings decreases as the inclination of the retainer increases, and could cancel the retained state of the terminal fittings. Therefore, a demand for countermeasures exists.

The invention was developed in view of the above situation, and an object thereof is to provide a connector capable of suppressing the inclination of a retainer and reliably holding one or more terminal fittings retained particularly even if cavities are arranged in a row in the connector.

SUMMARY OF THE INVENTION

The invention relates to a connector with a housing that has cavities for receiving terminal fittings. The connector also has a retainer with a main body that is movable between first and second positions in the housing. The terminal fittings can be inserted into the cavities and withdrawn therefrom when the retainer is at the first position. However, the retainer locks the terminal fittings in the housing when the retainer is at the second position. The main body of the retainer has at least one side plate that extends substantially in an inserting direction of the retainer. A plate surface of the side plate faces in a direction intersecting a longitudinal direction of the retainer main body. At least one side-plate inclination preventing part is provided and cooperates with the side plate to prevent an inclination of the retainer.

A retainer mounting portion preferably is formed in the side surface of the housing and penetrates the cavities. The retainer is mountable in the retainer mounting portion.

The side-plate inclination preventing part preferably comprises at least one locking arm formed at front and/or back parts of the side plate. The locking arm preferably cantilevers substantially in the inserting direction of the retainer, and is engageable with the housing for locking the retainer at the first or second position.

At least two locking arms are provided, and at least one reinforcement preferably is provided between the locking arms.

The side-plate inclination preventing part preferably comprises at least one rib on a surface of the housing facing the plate surface of the side plate and substantially adjacent to the side plate when the retainer is at the second position.

Retaining portions preferably are provided at positions of the retainer main body corresponding to the respective cavities. The retaining portions are retracted from the respective cavities when the retainer is at the first position and lock the respective terminal fittings when the retainer is at the second position.

The side-plate inclination preventing part preferably comprises ribs in the retaining mounting portion and located respectively before and behind the side plate. The reinforcement preferably is inserted between the front and back ribs when the retainer is inserted into the retainer mounting portion. More particularly, the ribs preferably extend substantially along the front and rear edges of the reinforcement. The ribs guide the reinforcement and ensure a stable inserting posture so that the retainer can be mounted smoothly.

An interval between the front and back ribs preferably is slightly larger than the width of the reinforcements in forward and backward directions. Thus, the rib is right behind the reinforcement when the retainer is at the full locking position. The reinforcement contacts the rib and limits inclination of the retainer in response to a force that acts to withdraw the terminal fittings. Thus, inclination of the retainer is suppressed and the terminal fittings are retained reliably even if the cavities are arranged in a row.

The side-plate inclination preventing part preferably comprises at least locking piece on the retainer and at least one locking-piece mounting portions. The locking pieces are fit into the corresponding locking-piece mounting portions when the retainer is at the second position. Distal surfaces of the locking pieces preferably face ceiling surfaces of the locking-piece mounting portions when the retainer is at the second position.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
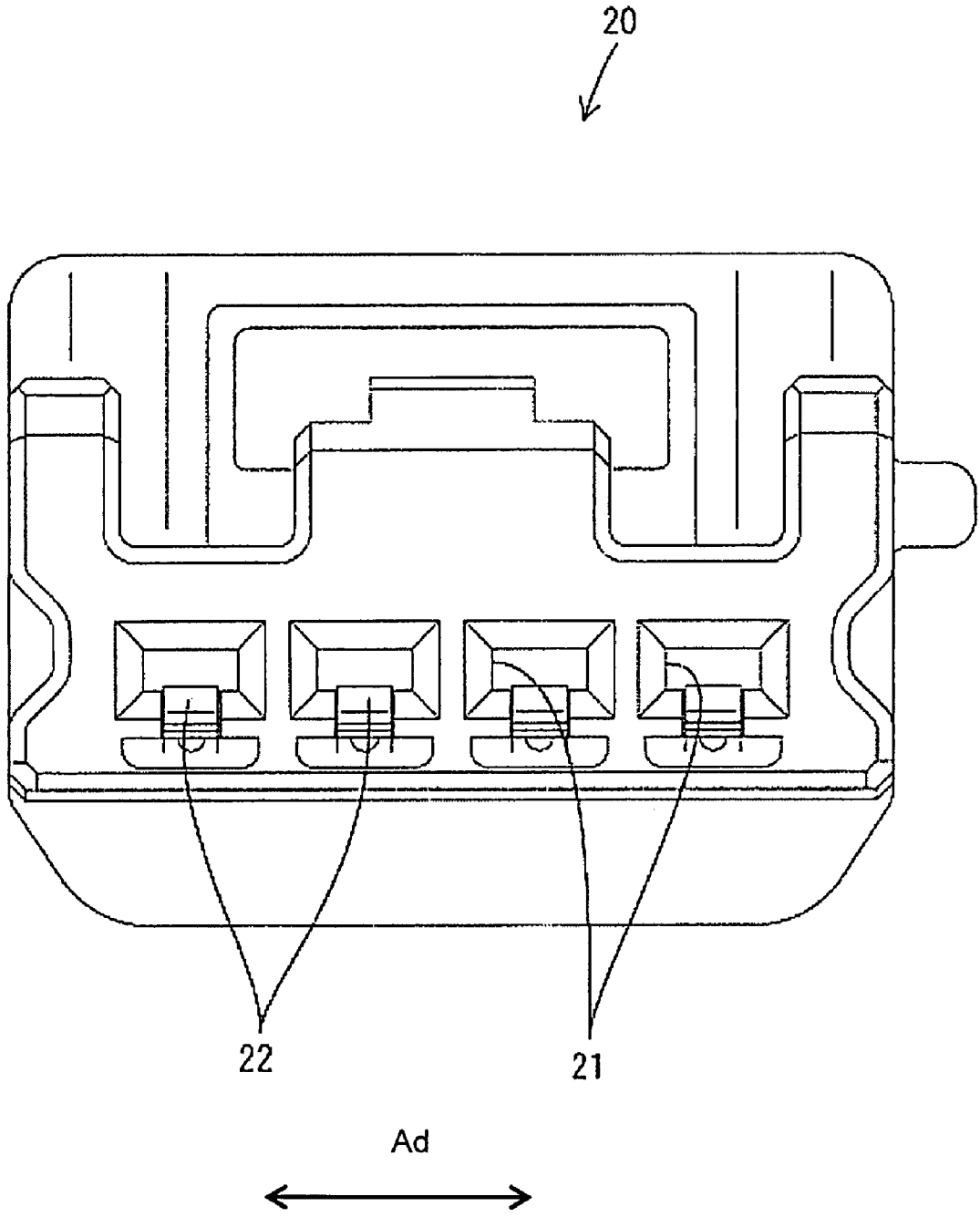
FIG. 1 is a front view of a housing according to a first embodiment.

A connector according to a first embodiment of the invention is identified by the numeral 1 in FIGS. 1 to 8. The connector 1 has a housing 20 capable of accommodating terminal fittings 10. An inserting direction ID of the terminal fittings 10 into the housing 20 is referred to as the forward direction, and upper and lower sides in FIG. 1 are referred to as the top and bottom.

Figure 3:
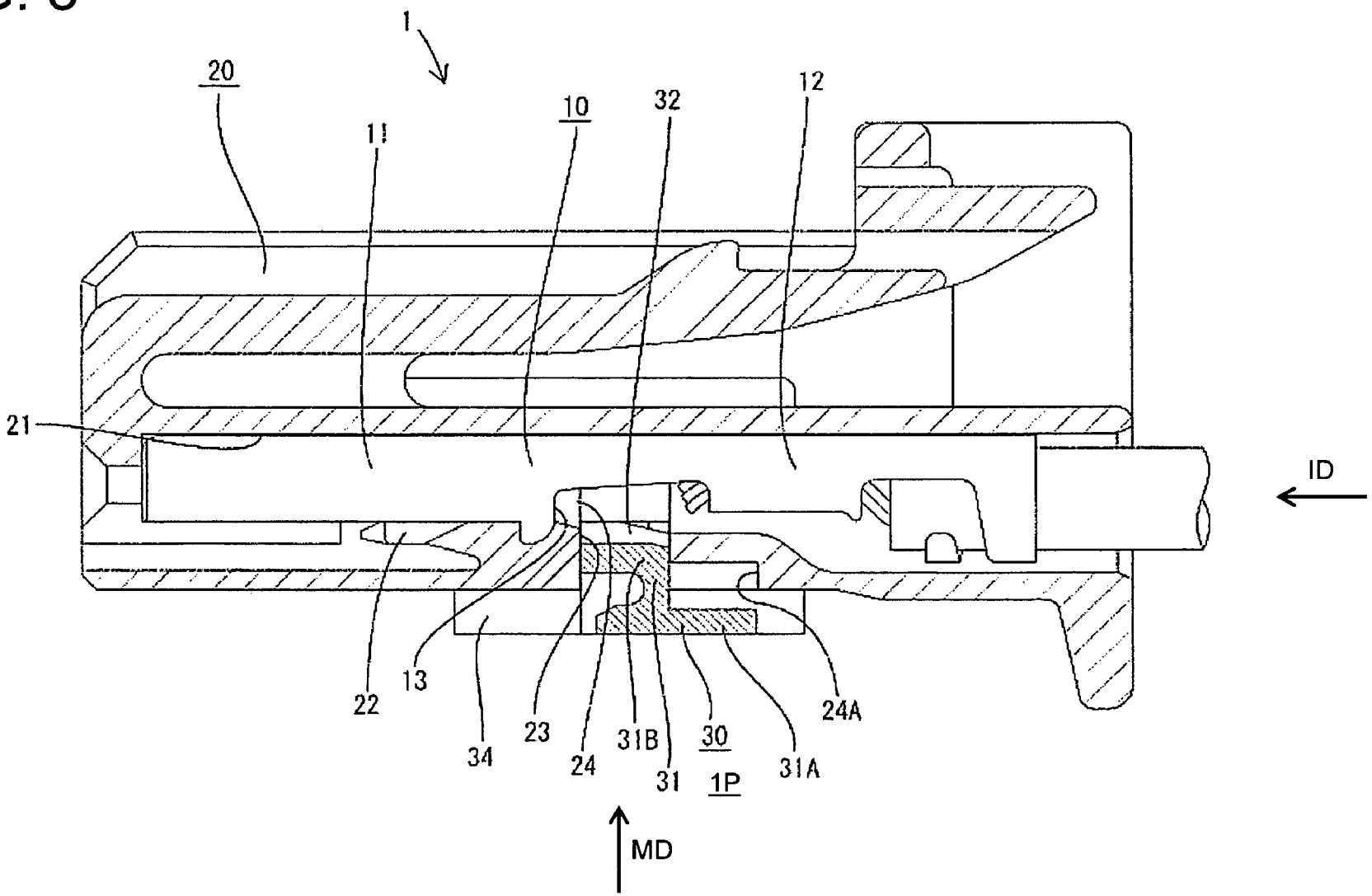
FIG. 3 is a longitudinal section of a connector showing a state where a retainer is held at a partial locking position.

The housing 20 is made e.g. of a synthetic resin, and cavities 21 are formed in a transverse row in the housing 20, as shown in FIGS. 1 and 3. Terminal fittings 10 are insertable into and withdrawable from each cavity 21 from the rear. A lock 22 is formed in each cavity 21 for primarily locking the terminal fitting 10 inserted to a proper position.

Figure 2:
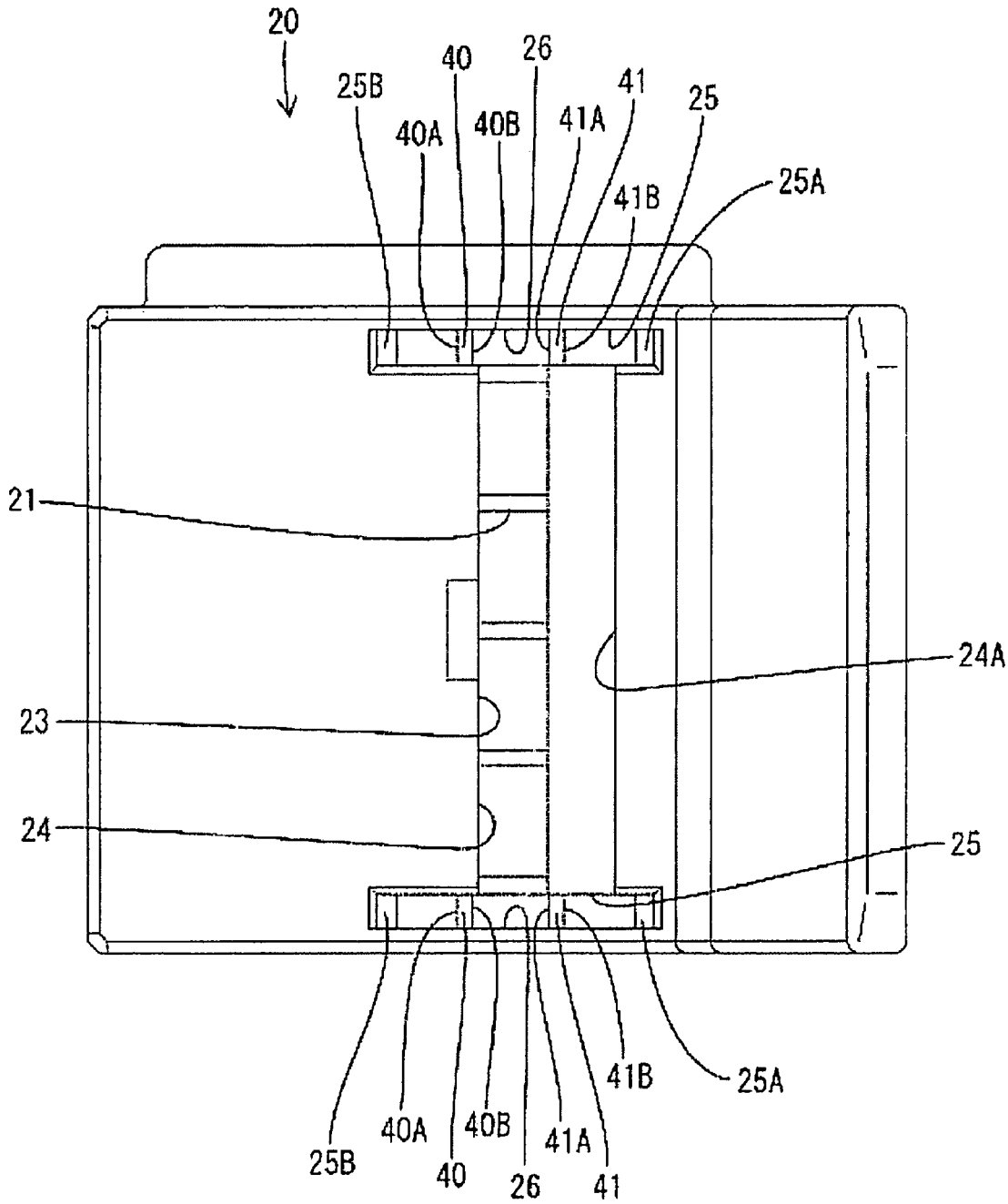
FIG. 2 is a bottom view of the housing.

A retainer mounting portion 23 is formed in the bottom surface of this housing 20 and communicates with the cavities 21. As shown in FIG. 2, the retainer mounting portion 23 includes a main-body mounting portion 24 and two side-plate mounting portions 25. The main-body mounting portion 24 is a wide substantially rectangular opening in the bottom surface of the housing 20 and communicates with intermediate parts of all cavities 21 with respect to forward and backward directions. The side-plate mounting portions 25 are narrow grooves that extend along the opposite transverse ends of the main-body mounting portion 24 and project forward and back from the main-body mounting portion 24.

A bottom opening edge 24A of the main-body mounting portion 24 is widened more backward than an upper part of the main-body mounting portion 24. A rear part of the opening edge 24A is formed by recessing the bottom surface of the housing 20 in and up, as shown in FIG. 3.

Figure 7:
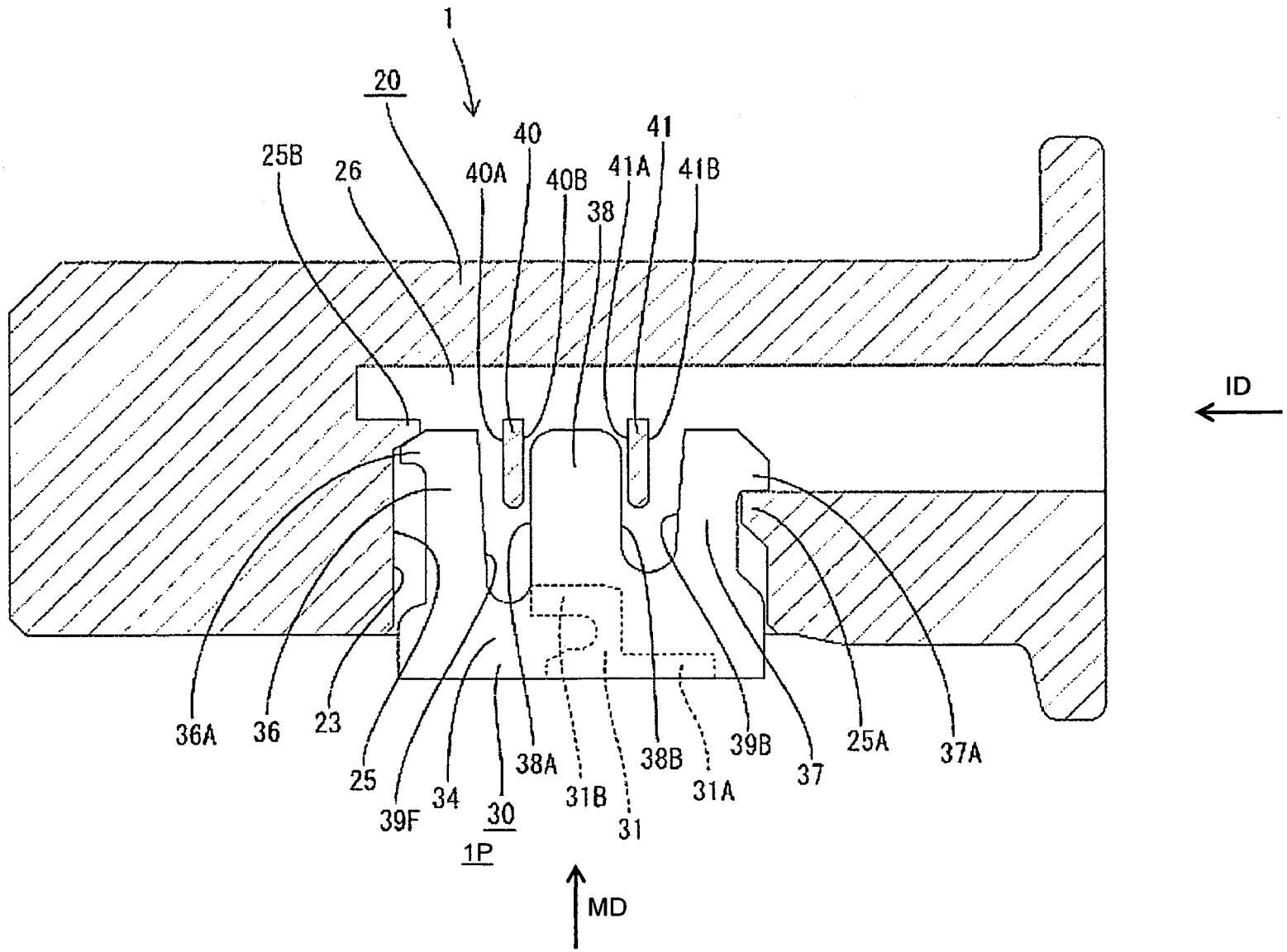
FIG. 7 is a longitudinal section at the position of a side-plate mounting portion when the retainer is held at the partial locking position.

As shown in FIGS. 2 and 7, partial locking projections 25A project forward from the rear edges of the side-plate mounting portions 25, and full locking projections 25B project back at positions of the front edges of the side-plate mounting portions 25 slightly above the partial locking projections 25A.

Each terminal fitting 10 is long and narrow in forward and backward directions and is formed by bending, folding and/or embossing a conductive metal plate that has been punched or cut into a specified shape. A substantially rectangular tube 11 is formed at the front end of each terminal fitting 10 and is connectable with a mating terminal fitting (not shown). A barrel 12 is formed at the rear of the terminal fitting 10 and is configured to be crimped, bent or folded into connection with a wire, as shown in FIG. 3. A primary locking portion (not shown) is provided in the lower surface of the rectangular tube 11 and is engageable with the lock 22, and a secondary locking portion is defined at the rear edge of the rectangular tube 11.

The connector 1 also includes a retainer 30 that can be mounted through a surface of the housing 20 that extends along an arranging direction AD of the cavities 21. More particularly, the retainer 30 is movable along a mounting direction MD that is substantially normal to the inserting direction. The retainer 30 is retracted from the cavities 21 at a partial locking position 1P (see FIG. 3) so that the terminal fittings 10 can be inserted into the cavities 21 and withdrawn therefrom. However, the retainer 30 projects into the cavities 21 at a full locking position 2P (see FIG. 4) and retains the terminal fittings 10.

Figure 5:
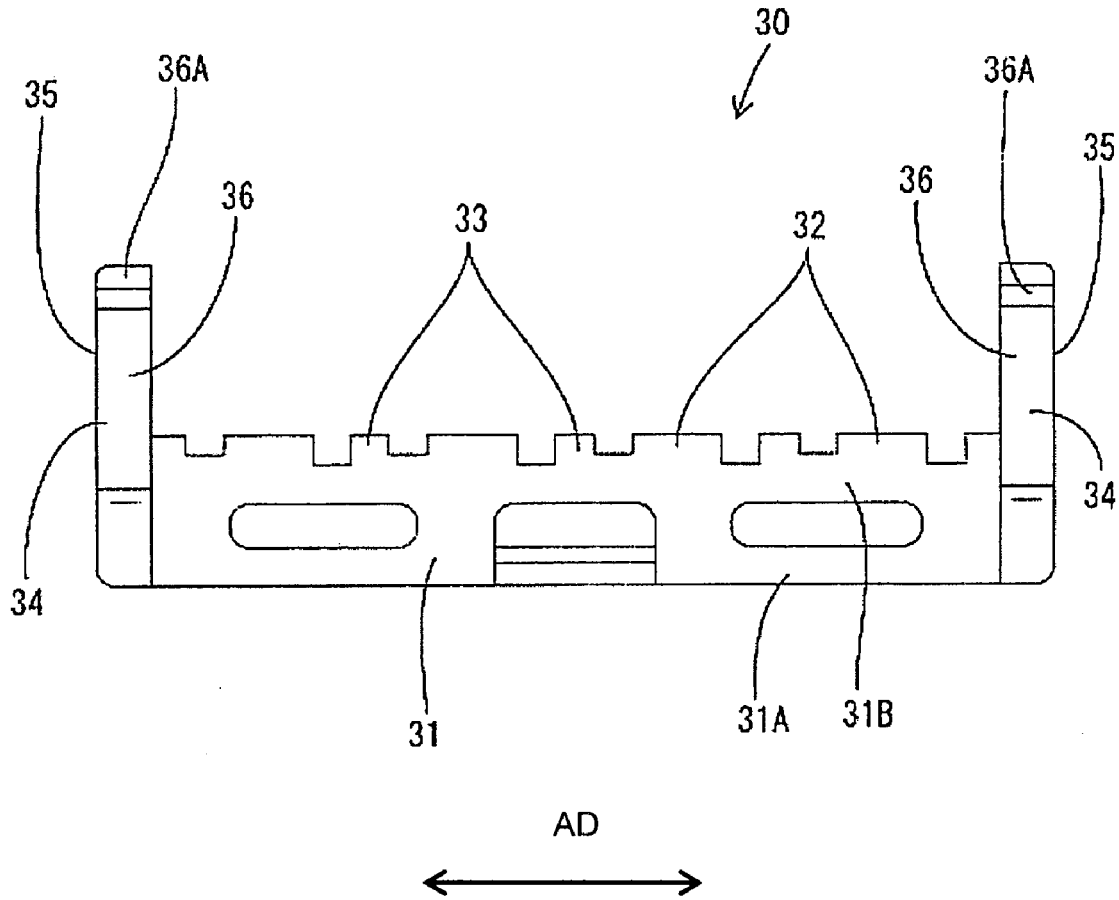
FIG. 5 is a front view of the retainer.
Figure 6:
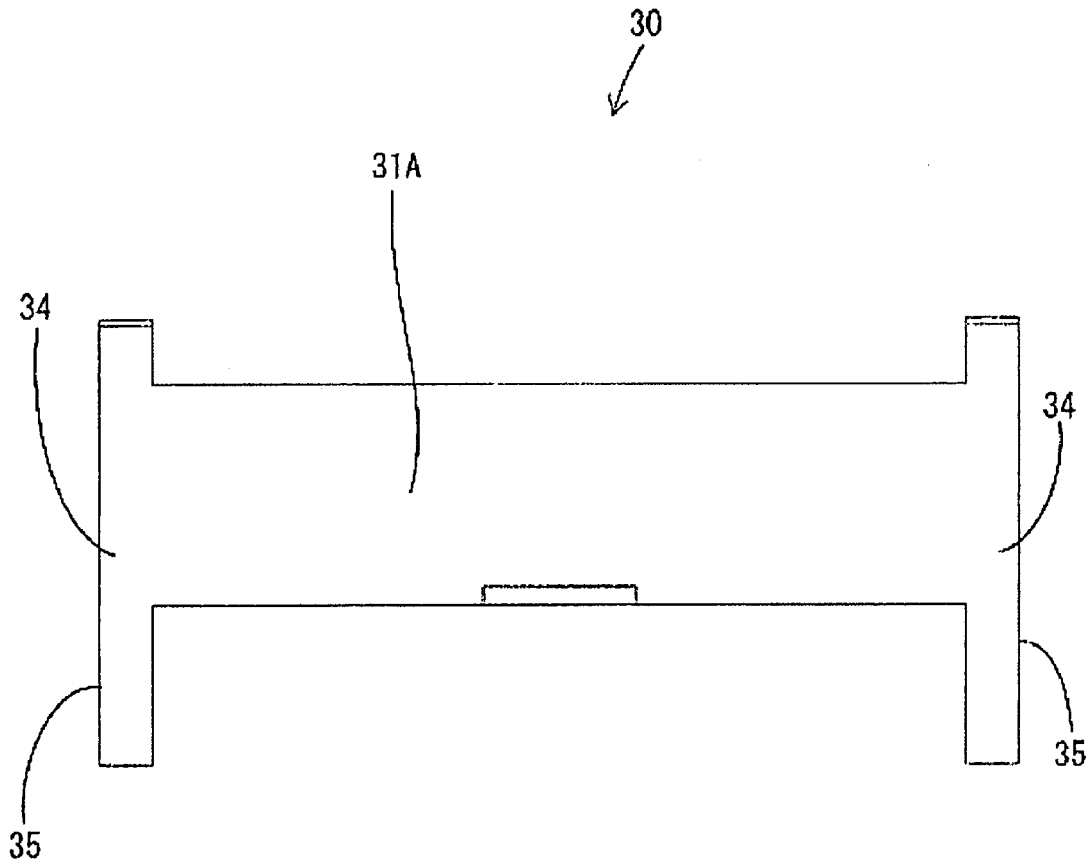
FIG. 6 is a bottom view of the retainer.

This retainer 30 is made e.g. of a synthetic resin and has a wide retainer main body 31 that extends in the arranging direction AD of the cavities 21, as shown in FIG. 5. The retainer main body 31 includes a wide substantially flat rectangular bottom plate 31A, as shown in FIG. 6. The bottom plate 31A fits in and closes the retainer mount portion 23 when the retainer 30 is at the full locking position 2P, as shown in FIG. 3. Additionally, the lower surface of the bottom plate 31A is substantially flush with the bottom surface of the housing 20 with the retainer 30 at the full locking position 2P.

Figure 4:
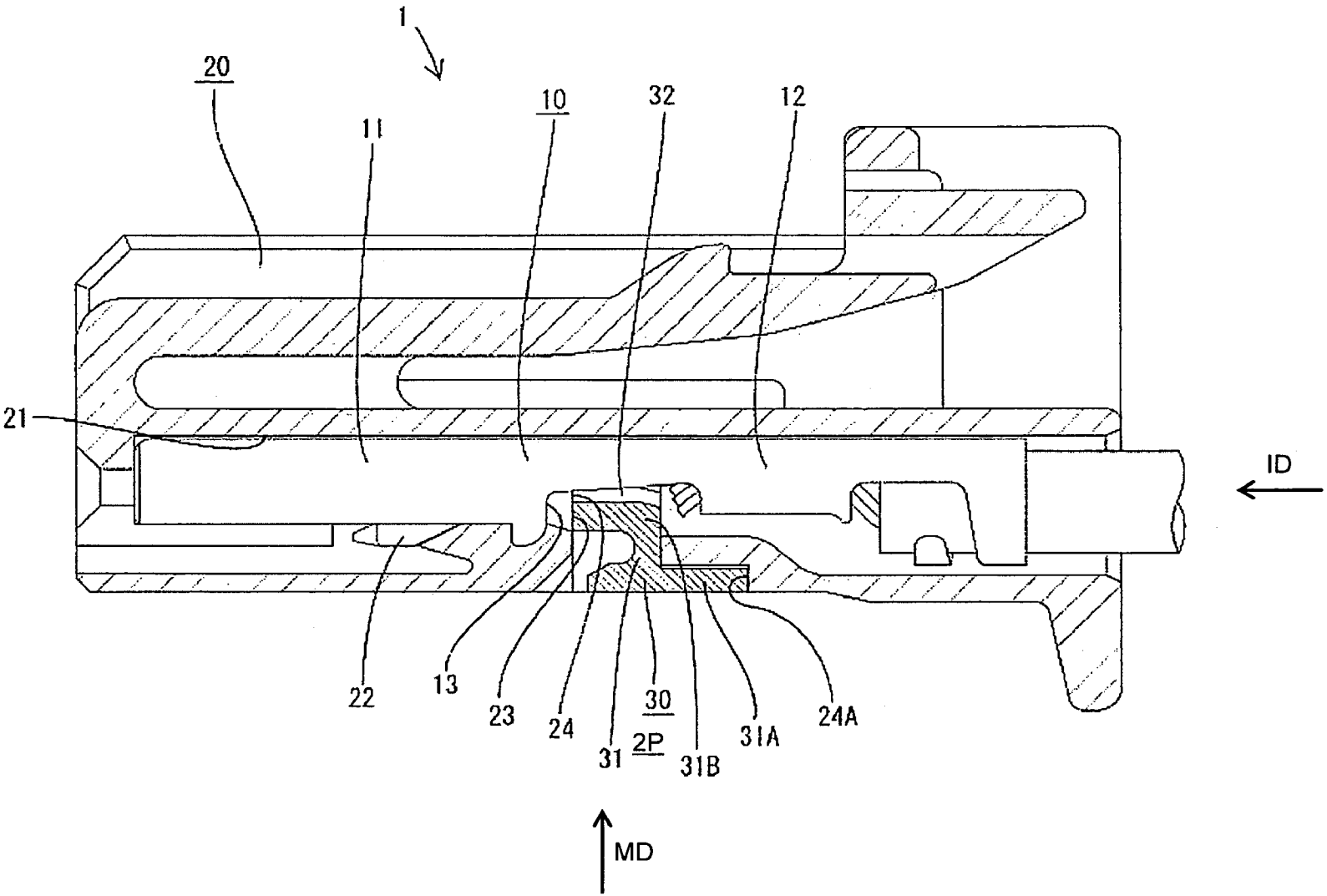
FIG. 4 is a longitudinal section of the connector showing a state where the retainer is held at a full locking position.

The retainer main body 31 also includes an insertion portion 31B that is formed near a front part of the bottom plate 31A. The upper surface of the insertion portion forms the lower surfaces of the respective cavities 21 when the retainer 30 is at the full locking position 2P as shown in FIG. 4. Retaining portions 32 are formed on the upper surface of the insertion portion 31B at positions corresponding to the respective cavities 21. The retaining portions 32 are retracted from the cavities 21 when the retainer 30 is at the partial locking position 1P. However, the retaining portions 32 project into the cavities 21 to lock the secondary locking portions 13 of the respective terminal fittings 10 when the retainer 30 is at the full locking position 2P. Partition walls 33 are formed on the upper surface of the insertion portion 31B and cooperate with partition walls of the housing 20 to partition the cavities 21 when the retainer 30 is at the full locking position 2P.

As shown in FIG. 5, two side plates 34 project up in the mounting direction MD of the retainer 30 from the opposite widthwise ends of the retainer main body 31. Plate surfaces of the side plates 34 face in a direction intersecting the longitudinal direction of the retainer main body 31. The side plates 34 can be mounted into the side-plate mounting portions 25 of the retainer mounting portion 23 so outer side surfaces 35 of the side plates 34 face the wall surfaces 26 of the side-plate mounting portion 25, as shown in FIG. 2.

As shown in FIG. 7, a full holding arm 35 and a temporary holding arm 37 are formed on the front and back ends of each side plate 34. The full holding arm 36 and temporary holding arm 37 are cantilevered up to substantially the same height in the mounting direction MD of the retainer 30 and are resiliently deformable towards each other in directions intersecting the inserting or mounting direction MD.

A temporary holding projection 37A projects back from the upper end of each temporary holding arm 37, whereas a full holding projection 36A projects forward from the upper end of each full holding arm 36. The temporary holding projections 37A engage the partial locking projections 25A (see FIG. 7) when the retainer 30 reaches the partial locking position 1P, whereas the full holding projections 36A engaged the full locking projections 25B (see FIG. 8) when the retainer 30 reaches the full locking position 2P.

A reinforcement 38 is provided in each side plate 34 between the full holding arm 36 and the temporary holding arm 37 and projects up to substantially the same height as the two arms 36, 37. Front and back slits 39F and 39B are formed between the reinforcement 38 and the two arms 36, 37.

Each reinforcement 38 has a vertically long substantially rectangular shape when viewed sideways, and has rounded front and rear corners at the upper end thereof. Front and back surfaces 38A and 38B of each reinforcement 38 are substantially perpendicular to the surface of the bottom plate 31A, whereas surfaces of the two arms 36, 37 facing the reinforcement 38 are inclined to gradually approach each other from the top toward the bottom, thereby gradually narrowing the widths of the respective slits 39F, 39B in forward and backward directions towards the bottom. The front slit 39F has a deeper cut depth than the back slit 39B and the vertical length of the front surface 38A is longer than the back surface 38B for each reinforcement 38. Bottom ends of the respective slits 39F, 39B preferably are arcuate.

Front and back ribs 40 and 41 are provided on the wall surface 26 of each side-plate mounting portion 25. The front and back ribs 40, 41 are arranged above a substantially vertical middle position of the retainer mounting portion 23 and at a back side with respect to the mounting direction MD of the retainer 30. As shown in FIG. 2, the ribs 40, 41 project in from the wall surfaces 26 of the side-plate mounting portions 25 and the projecting ends of the ribs 40, 41 are connected with the surfaces of the side-plate mounting portions 25 facing the wall surfaces 26.

Figure 8:
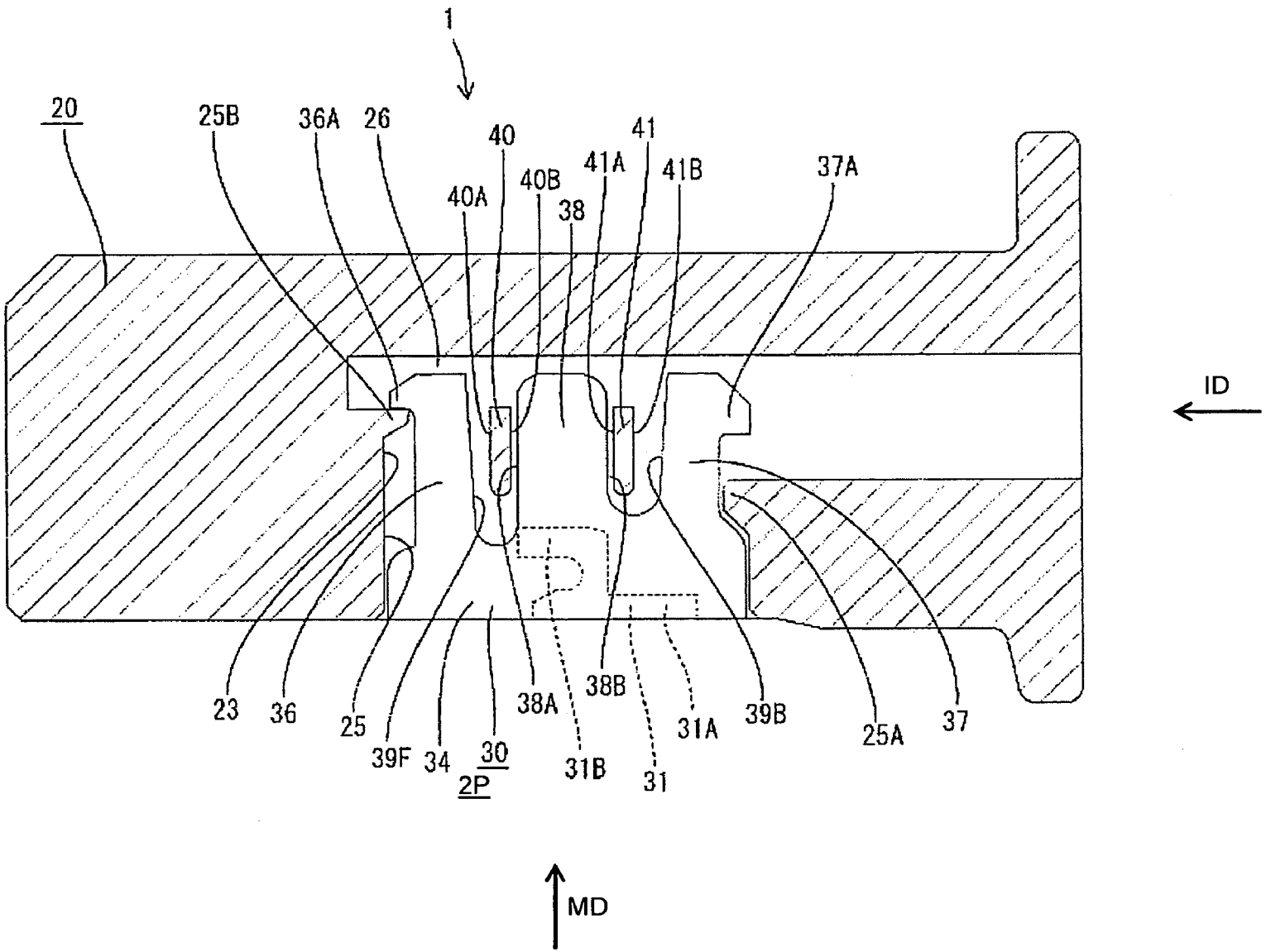
FIG. 8 is a longitudinal section at the position of the side-plate mounting portion when the retainer is held at the full locking position.

The ribs 40, 41 have substantially rectangular cross sections narrow and long along the mounting direction MD or vertically when viewed sideways. Front and back surfaces 40A, 40B of the front rib 40 and front and back surfaces 41A, 41B of the back rib 41 are substantially parallel to each other, as shown in FIG. 7. Further, the vertical dimensions of the ribs 40, 41 preferably are substantially equal to the vertical dimension of straight parts of the back surfaces 38B of the reinforcing portions 38, excluding the round parts, as shown in FIG. 8. It should be noted that the bottom ends of the respective ribs 40, 41 preferably are rounded. Thus, the rounded corners of the upper ends of the reinforcements 38 contact the rounded bottom ends of the ribs 40, 41 if the retainer 30 is inserted into the retainer mounting portion 23 while being slightly inclined, and the retainer 30 can be inserted smoothly without getting caught each other.

An interval between the front ribs 40 and the back ribs 41 is slightly larger than the width of the reinforcements 38 in forward and backward directions. Therefore small clearances are defined between the back surfaces 40B of the front ribs 40 and the front surfaces 38A of the reinforcements 38 and between the front surfaces 41A of the back ribs 41 and the back surfaces 38B of the reinforcements 38. The back surfaces 40B of the front ribs 40 and the front surfaces 38A of the reinforcements 38, and the front surfaces 41A of the back ribs 41 and the back surfaces 38B of the reinforcements 38 are substantially parallel, and the reinforcements 38 are fit closely between the ribs 40, 41 while being permitted to vertically move.

The front and back ribs 40 and 41 are close to the reinforcements 38 in the front slits 39F and back slits 39B, and spaces are defined between the front ribs 40 and the full holding arms 36 and between the back ribs 41 and the temporary holding arms 37. The arms 36, 37 are deformable in the spaces to an extent sufficient for the respective full and temporary holding projections 36A and 37A to move over the full and partial locking projections 25B and 25A.

The retainer 30 initially is inserted into the retainer mounting portion 23 from below the housing 20 and along the mounting direction MD so that the upper ends of the respective reinforcements 38 are inserted between the corresponding pairs of front and back ribs 40, 41. The reinforcements 38 are guided between the corresponding pairs of ribs 40, 41 with the front and back surfaces 38A, 38B parallel to the back surfaces 40B of the front ribs 40 and the front surfaces 41A of the back ribs 41. The upper ends of the reinforcements 38, the full holding arms 36 and the temporary holding arms 37 reach positions near the upper ends of the ribs 40, 41 when the retainer 30 reaches the partial locking position 1P, and the front and back ribs 40, 41 are at positions immediately before and behind substantially upper halves of the reinforcements 38, as shown in FIG. 7. Further, the temporary holding projections 37A are engaged with the partial locking projections 25A to hold the retainer 30 at the partial locking position 1P. Thereafter, the four terminal fittings 10 are inserted successively into the respective cavities 21.

The lower surface of the bottom plate 31A of the retainer 30 then is pushed up in the mounting direction MD to move the retainer 30 from the partial locking position 1P to the full locking position 2P. As a result, the back surfaces 40B of the front ribs 40 and the front surfaces 41A of the back ribs 41 guide the reinforcements 38 into the space between the ribs 40, 41. The curved upper corners of the reinforcements 38 project up in the mounting direction MD beyond the corresponding ribs 40, 41 when the retainer 30 is in the full locking position 2P, as shown in FIG. 8. Additionally, the front ribs 40 are right before the straight parts of the front surfaces 38A of the reinforcements 38 and the back ribs 41 are right before the straight parts of the back surfaces 38B of the reinforcements 38 when the retainer 30 is in the full locking position 2P. Thus, the retainer 30 is guided in a stable posture without inclining during its movement to the full locking position 2P. Further, the retainer 30 has a well-balanced guidance at the opposite widthwise ends thereof. The full holding projections 36A engage the full locking projections 25B to hold the retainer 30 at the full locking position 2P and the terminal fittings 10 are locked secondarily by the retaining portions 32.

The terminal fittings 10 could be pulled strongly while the retainer 30 is mounted at the full locking position 2P. Thus, the retaining portions 32 secondarily engaged with the terminal fittings 10 are pushed back and the retainer 30 tries to incline in a direction so that the rear end thereof comes out of the retainer mounting portion 23. At this time, the back surfaces 38B of the reinforcing portions 38 contact the front surfaces 41A of the back ribs 41 arranged at the positions right behind the back surfaces 38B. Therefore, any further inclination of the retainer 30 is prevented.

The front and back ribs 40, 41 on each wall surface 26 of the retainer mounting portion 23 guide the retainer and prevent inclination. Thus, economic efficiency is better as compared to the case where the shapes of the housing and the retainer must be changed such as by forming the housing and the retainer with mutually engageable parts.

The ribs 40, 41 on the inner surfaces of the opposite side walls of the housing 20 also function to reinforce the opposite side walls. Thus, the side walls can be thinner without reducing their strength thickness, and the housing 20 can be miniaturized.

To detach the terminal fitting 10, the retainer 30 is moved from the full locking position 2P to the partial locking position 1P in a procedure opposite to the above. The lock 22 then is disengaged and the terminal fitting 10 can be withdrawn. The reinforcements 38 located between the ribs 40, 41 also guide the retainer 30 to the partial locking position 2P. Accordingly, the retainer 30 can be moved without deviating from a specified path and can be kept in a specified posture. Therefore, operability in inserting and detaching the retainer 30 into and from the retainer mounting portion 23 is good.

As described above, the back ribs 41 are right behind the reinforcements 38 when the retainer 30 is at the full locking position 2P. A force to withdraw the terminal fittings 10 would act on the retaining portions 32 and could urge the retainer 30 towards an inclined posture. However, the reinforcements 38 will contact the back ribs 41 to prevent or limit inclination of the retainer 30. The inability of the retainer 30 to incline significantly ensures that the terminal fittings 10 will be held securely even if the connector 1 has the cavities 21 are arranged in a row. Further, the retainer 30 need not change its shape, and it is sufficient to provide the back ribs 41 on the housing 20.

The front ribs 40F are located before the reinforcements 38 and the reinforcements 38 are inserted between the corresponding pairs of front and back ribs 40, 41 as the retainer 30 is inserted into the retainer mounting portion 23. The ribs 40, 41 stabilize and guide the reinforcements 38 to ensure that the retainer 30 can be mounted smoothly. In addition, the ribs 40, 41 in each pair extend along the front and back surfaces 38A, 38B of the corresponding reinforcement 38 to stabilize the retainer 30 even more.

A connector according to a second embodiment of the invention is identified by the numeral 60 in FIGS. 9 to 13. Parts of the connector 60 that are the same as or similar to the first embodiment are not described again, and merely are identified by the same reference numerals.

Figure 9:
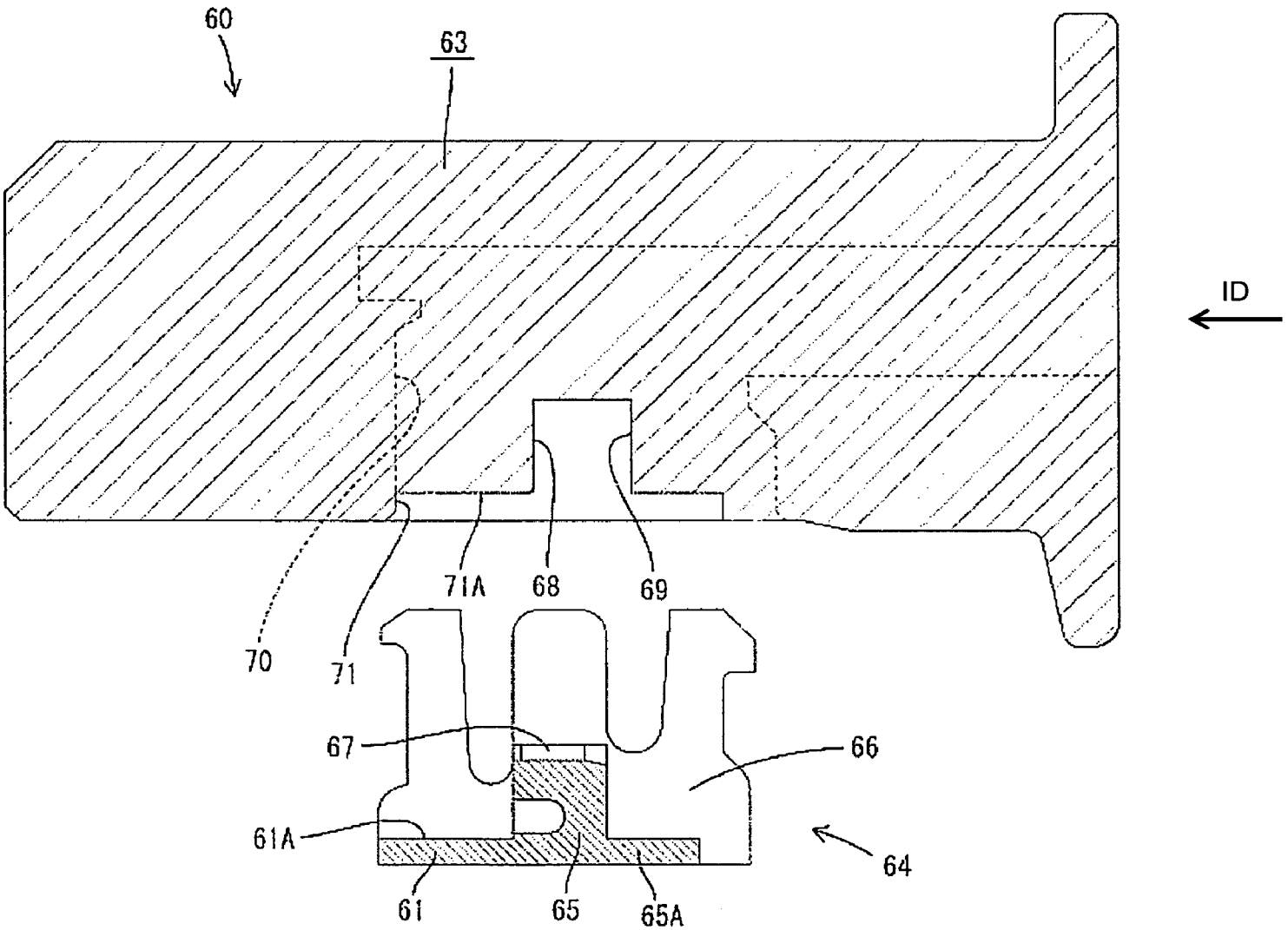
FIG. 9 is a longitudinal section of a connector according to a second embodiment showing a state before a retainer is inserted into a housing.

As shown in FIG. 9, the connector 60 has cavities 62 arranged in a row in a housing 63. The connector 60 also has a retainer 64 to be inserted into the housing 63 from below and along a mounting direction MD, as in the first embodiment.

Figure 10:
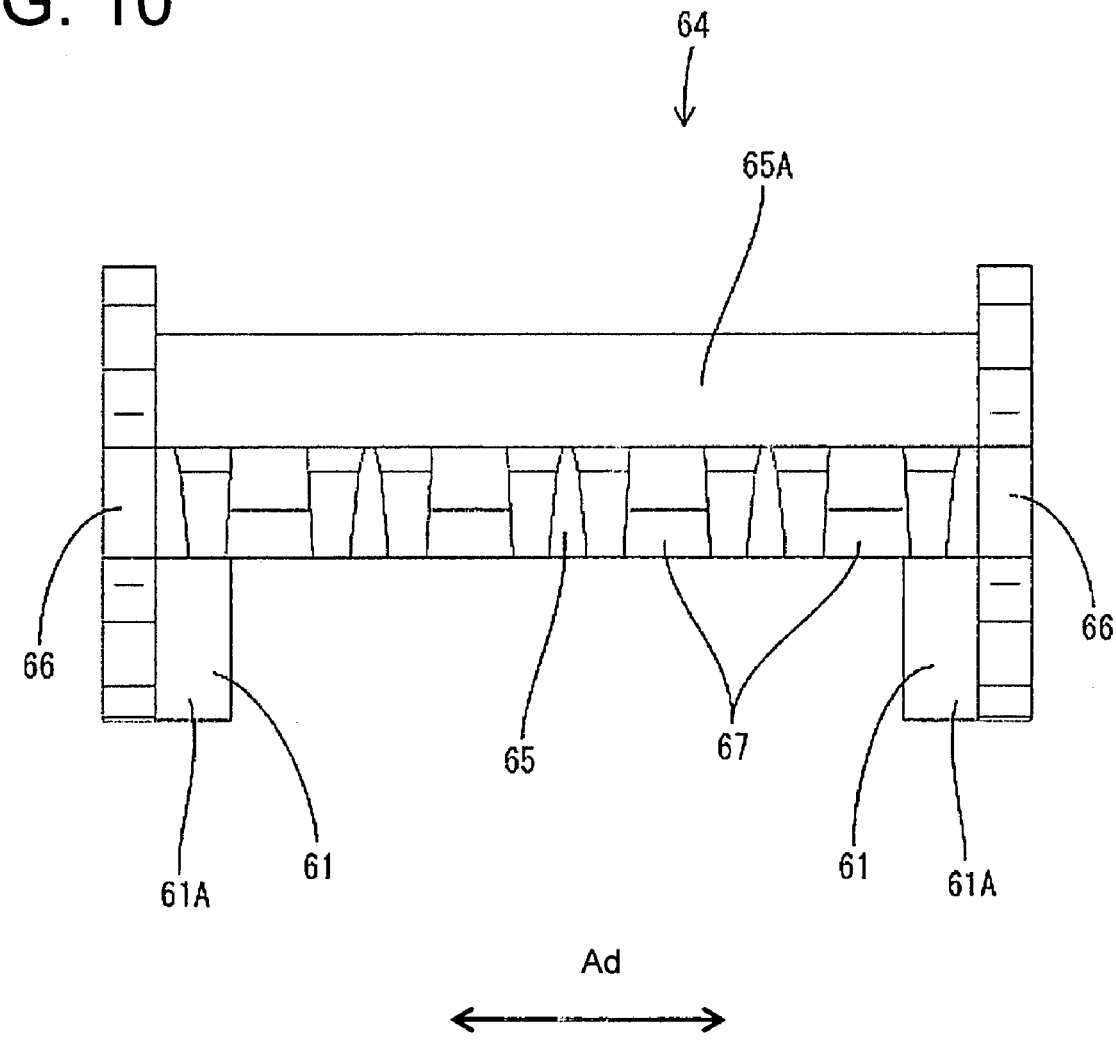
FIG. 10 is a top view of the retainer.

As shown in FIG. 10, the retainer 64 has a transversely long retainer main body 65 and side plates 66 are provided at the opposite longitudinal ends of this retainer main body 65, similar to the first embodiment.

Two locking pieces 61 are arranged at positions inward of and near the side plates 66, and define substantially rectangular flat plates that bulge out from the front end surface of the bottom plate 65A of the retainer main body 65 and from the bottom ends of the inner surfaces of the side plate 66. As shown in FIG. 9, the respective locking pieces 61 bulge forward with substantially the same thickness as the bottom plate 65A and the front edges of the locking pieces 61 are at the same position as the front edges of the side plates 66. Further, the inner edges of the respective locking pieces 61 are at substantially the same positions as the widthwise outer edges of the laterally outermost retaining portions 67.

Figure 11:
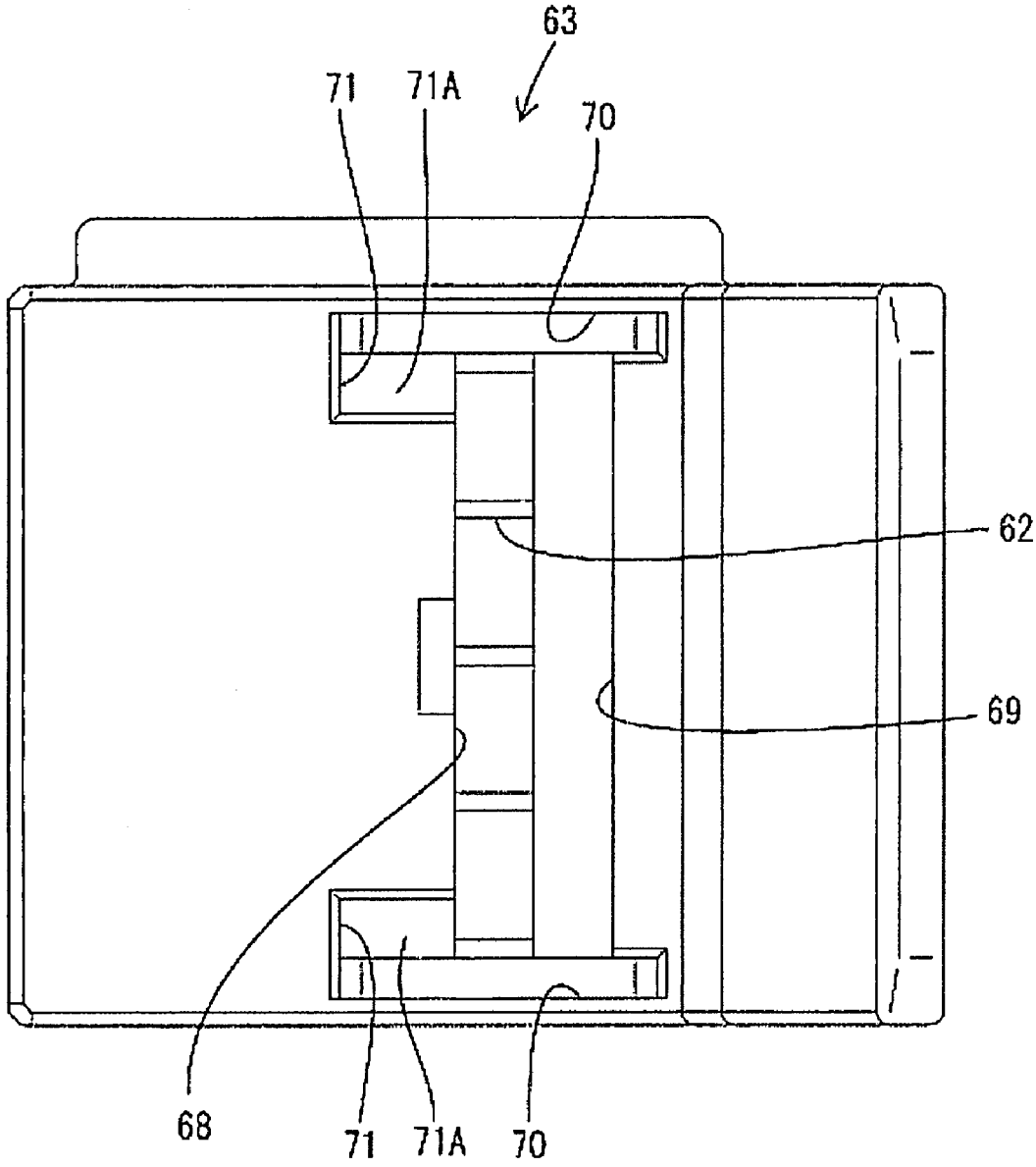
FIG. 11 is a bottom view of the housing.
Figure 12:
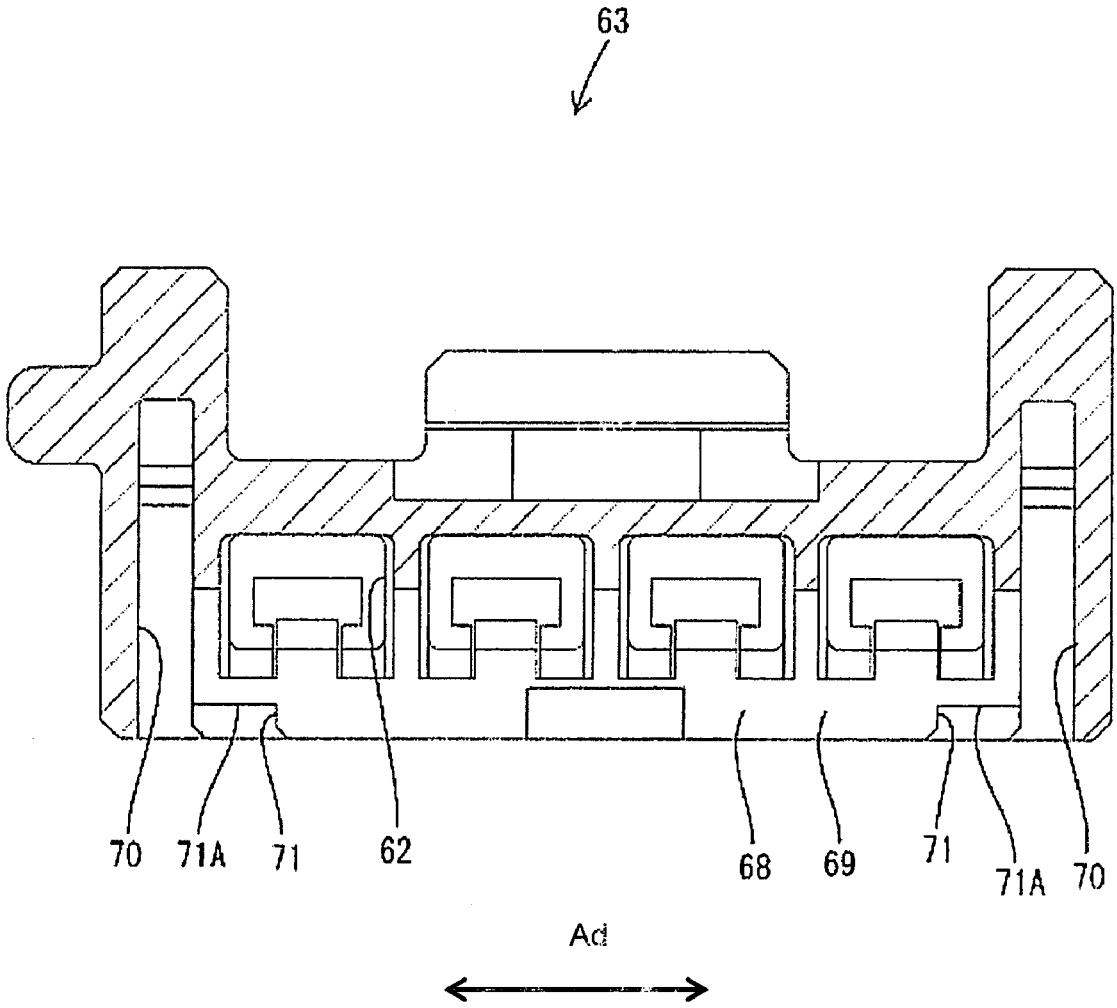
FIG. 12 is a transverse section of the housing.
Figure 13:
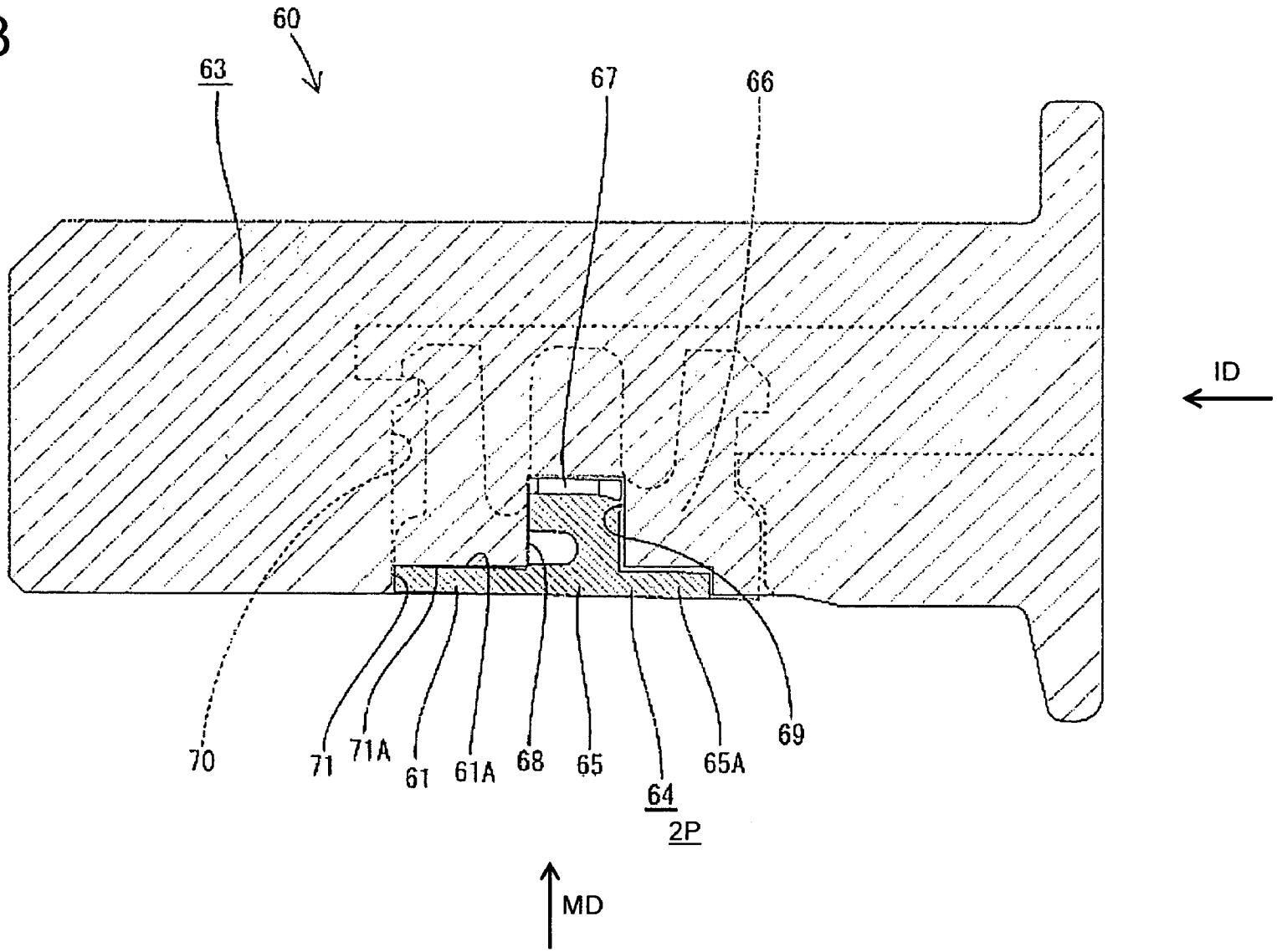
FIG. 13 is a longitudinal section of the connector showing a state where the retainer is held at a full locking position.

As shown in FIG. 11, two locking-piece mounting portions 71 are provided at the inner sides of both side-plate mounting portions 70 of the retainer mounting portion 68 and can receive the respective locking pieces 61. The respective locking-piece mounting portions 71 are formed by widening the bottom ends of the main-body mounting portion 69 and the side-plate mounting portions 70 forward and inward, as shown in FIGS. 11 and 12. The locking-piece mounting portions 71 are formed by recessing the lower surface of the housing 63 in and up, and have a substantially rectangular shape configured to receive the locking pieces 61 when viewed from below. The locking pieces 61 are fit into the corresponding locking-piece mounting portions 71 when the retainer 64 is at the full locking position 2P. Thus, the upper surfaces 61A of the locking pieces 61 face the respective ceiling surfaces 71A of the locking-piece mounting portions 71 and the lower surfaces thereof are flush with the bottom surface of the housing 63, as shown in FIG. 13.

A force could act to withdraw the terminal fittings 10 and could push the retaining portions 67 back so that the retainer 64 tries to incline. However, the front edges of the upper surfaces 61A of the locking pieces 61 contact the front edges of the ceiling surfaces 71A of the locking-piece mounting portions 71 to prevent any further inclination of the retainer 64. Accordingly, inclination of the retainer 64 can be suppressed.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

Two front ribs 40 and two rear ribs 41 are provided at the opposite widthwise end surfaces of the retainer mounting portion 23 in the first embodiment. However, inclination of the retainer may be suppressed merely by ribs at the rear sides of the reinforcements.

The invention is applied to the case where side plates 34 are at the opposite ends of the retainer 30. However, the invention also applies to the case where a side plate is at an intermediate part in addition or alternatively to the opposite ends. For example, a retainer may be very wide because of a multitude of contacts. In this case, ribs may be provided on the wall surfaces at the opposite ends of the retainer mounting portion, and also on a wall surface of a side-plate mounting portion formed in the middle. Then, the inclination of the retainer also is suppressed at the intermediate part in addition or alternatively to the opposite ends. As a result the inclination of the retainer having a multitude of contacts also can be suppressed reliably. It is not always necessary to form the ribs on the wall surfaces of all the side-plate mounting portions, and the ribs may be formed, for example, on only the wall surface of one of the side-plate mounting portions at the opposite ends or only on the wall surface of the side-plate mounting portion in the intermediate part provided that inclination of the retainer can be suppressed.

The ribs 40, 41 have substantially rectangular cross sections narrow and long in the vertical direction when viewed sideways in the first embodiment. However, the ribs may have any arbitrary shape and, for example, may have circular or triangular cross sections when viewed sideways.

The projecting ends of the ribs 40, 41 extend to the surfaces of the side-plate mounting portions 25 facing the wall surfaces 26 and are connected therewith in the first embodiment. However, they may not reach the facing surfaces if the ribs have a projecting distance capable of suppressing the inclination of the retainer by contacting the rear surfaces of the reinforcements.

The temporary holding arm 37 and the full holding arm 36 are provided respectively behind and before the reinforcement 38 in the first embodiment. However, the arrangement of the arms may be reversed.

Both arms 36, 37 and the reinforcements 38 project to substantially the same height in the first embodiment. However, the invention is not limited thereto and the height of the reinforcements may, for example, be shorter than the arms or the reinforcements and the arms may all have different heights.

What is claimed is:

1. A connector comprising:

a housing with cavities for receiving terminal fittings along an inserting direction;

a retainer insertable into the housing along a mounting direction that intersects the inserting direction and being movable between a first position that permits the insertion and withdrawal of the terminal fittings and a second position where the retainer locks and retains the terminal fittings in the cavities, the retainer including a main body, at least one side plate on the main body and extending substantially in the mounting direction of the retainer; and at least one side-plate inclination preventing part on at least one of the housing and the retainer and cooperating with the side plate and preventing inclination of the retainer, the side-plate inclination preventing part comprising locking arms formed on the side plate and cantilevered substantially in the mounting direction, the locking arms being engageable with the housing for locking when the retainer is at one of the first and second positions, a reinforcement being disposed between the locking arms, the side-plate inclination preventing part further comprising front and rear ribs provided on a surface of the housing and disposed so that the reinforcement is inserted between the front and rear ribs when the retainer is at the second position in the housing.

2. The connector of claim 1, wherein a retainer mounting portion extends into a side of the housing and communicates with the cavities, the retainer being mountable into the retainer mounting portion.

3. The connector of claim 1, further comprising retaining portions on the retainer main body at positions corresponding to the respective cavities, the retaining portions being retracted from the cavities when the retainer is at the first position and locking the respective terminal fittings when the retainer is at the second position.

4. The connector of claim 1, wherein the front and rear ribs extend substantially along front and rear edges of the reinforcement.

5. The connector of claim 1, wherein an interval between the front and rear ribs is slightly larger than a width of the reinforcements in forward and backward directions.

6. The connector of claim 1, wherein the side-plate inclination preventing part comprises locking pieces provided on the retainer and corresponding locking-piece mounting portions on the housing, the locking pieces being fit into the corresponding locking-piece mounting portions when the retainer is at the second position.

7. The connector of claim 6, wherein, distal surfaces of the locking pieces substantially face ceiling surfaces of the locking-piece mounting portions when the retainer is at the second position.

8. A connector, comprising:

a housing with opposite front and rear ends, cavities extending between the ends and aligned along an inserting direction, the housing further having opposite first and second side walls extending between the front and rear ends, a retainer mounting portion extending into a surface of the housing between the side walls, the retainer mounting portion extending along a mounting direction at an angle to the inserting direction, spaced apart front and back ribs on parts of each of the side walls facing into the retainer mounting portion; and a retainer insertable along the mounting direction and into the retainer mounting portion of the housing, the retainer being movable to a full locking position where parts of the retainer project into the cavities, the retainer including first and second side plates formed respectively with first and second reinforcements disposed for sliding insertion between the front and back ribs as the retainer is moved towards the full locking position for preventing inclination of the retainer.

9. The connector of claim 8, further comprising two locking arms formed on each of the side plates and cantilevered substantially in the inserting direction of the retainer, the locking arms being engageable with the housing for locking the retainer selectively either at a partial locking position where no part of the retainer blocks the cavities or at the full locking position.

10. The connector of claim 9, wherein the reinforcements are between the locking arms of the respective side plate.

11. The connector of claim 10, wherein each of the ribs is insertable between the respective reinforcement and one of the locking arms.

* * * * *